US006143092A

United States Patent [19]

Straub et al.

[11] Patent Number: 6,143,092

[45] Date of Patent: Nov. 7, 2000

[54] PROCESS FOR CLEANING A TRANSPORT BELT

[75] Inventors: Karlheinz Straub, Heidenheim; Markus Oechsle, Bartholomae; Gerhard Kotitschke, Steinheim, all of Germany

[73] Assignee: Voith Sulzer Papiermaschinen GmbH, Heidenheim, Germany

[21] Appl. No.: 09/347,925

[22] Filed: Jul. 6, 1999

Related U.S. Application Data

[63] Continuation-in-part of application No. 09/103,378, Jun. 24, 1998, Pat. No. 5,964,956.

[30] Foreign Application Priority Data

Jun. 25, 1997 [DE] Germany ..... 197 26 897

[51] Int. Cl.[7] ..... B08B 1/02; B08B 3/04; B08B 3/12; B08B 5/04

[52] U.S. Cl. ..... 134/15; 134/1; 134/18; 134/21; 134/32; 134/34; 134/37; 134/64 R; 134/57 R

[58] Field of Search ..... 134/1, 15, 18, 134/21, 32, 34, 37, 64 R, 57 R; 15/302, 309.1

[56] References Cited

U.S. PATENT DOCUMENTS

| | | | |
|---|---|---|---|
| 4,378,639 | 4/1983 | Walker | 34/12 |
| 5,783,044 | 7/1998 | Schneider et al. | 162/278 |

FOREIGN PATENT DOCUMENTS

| | | |
|---|---|---|
| 1143982 | 4/1983 | Canada . |
| 024205 | 2/1981 | European Pat. Off. . |
| 383486 | 8/1990 | European Pat. Off. . |
| 4419540 | 1/1995 | Germany . |
| 3234885 | 10/1991 | Japan . |
| 2230620 | 10/1990 | United Kingdom . |
| 9626317 | 8/1996 | WIPO . |

OTHER PUBLICATIONS

English language abstract of JP–3–234885.

*Primary Examiner*—Zeinab El-Arini
*Attorney, Agent, or Firm*—Greenblum & Bernstein, P.L.C.

[57] ABSTRACT

Process for cleaning a transport belt of a machine for manufacturing and/or processing a material web with at least one cleaning device. The process includes detecting the contamination of the transport belt with at least one sensor, generating a state matrix which contains the location coordinates of the detected contamination, and one of controlling and regulating the at least one cleaning device for cleaning over at least a width of the transport belt with a varying desired intensity of cleaning in accordance with the generated state matrix.

25 Claims, 5 Drawing Sheets

PROCESS FOR CLEANING A TRANSPORT BELT

CROSS-REFERENCE TO RELATED APPLICATIONS

The present application is a Continuation-In-Part Application of U.S. patent application Ser. No. 09/103,378 filed Jun. 24, 1998, now U.S. Pat. No. 5,964,956, and, thereby, claims priority under 35 U.S.C. § 119 German Patent Application No. 197 26 897.8 filed on Jun. 25, 1997, the disclosures of which are expressly incorporated by reference herein in their entireties.

BACKGROUND OF THE INVENTION

1. Field of the Invention

The present invention relates to a process for cleaning a transport (conveyor) belt of a machine for manufacturing and/or processing a material web, e.g., a paper or cardboard web, with varying intensity of the cleaning at least over the total width of the transport belt. The present invention also relates to an apparatus for cleaning a transport belt of a machine for manufacturing and/or processing a material web, e.g., a paper or cardboard web.

2. Discussion of Background Information

In machines for manufacturing a material web, e.g., a paper or cardboard web, numerous transport (conveyor) belts are used, e.g., woven cloth belts. Theses belts can become soiled during the continuous operation of the machine with, e.g., fibers of the material web, adhesives, or other added substances that clog up the meshes and pores of transport belts. In order to ensure an uninterrupted production process, the transport belts are cleaned with a cleaning device. There are known cleaning devices that include one or a number of nozzles that can be acted on with a pressurized cleaning medium. The nozzle can be moved laterally to a travel direction of the transport belt and applies the cleaning medium evenly to the surface of the transport belt. Further, there are known cleaning devices that have a nozzle bar which extends laterally to the travel direction of the transport belt and which has a number of nozzles attached to it. In this manner, a cleaning medium can be applied to the transport belt.

It has been found that the transport belts become soiled with an uneven severity laterally to the travel direction, i.e., the transport belt can be soiled particularly severely in the edge regions while there is only a slight contamination in the center of the transport belt. In such instances, the uniform cleaning action of the known cleaning devices cannot always produce satisfactory cleaning results. Moreover, unsatisfactory cleaning results can lead to interruptions of the production process and to a loss in quality of the finished product.

SUMMARY OF THE INVENTION

The present invention, therefore, provides a process and apparatus that do not suffer from the above-noted disadvantages of the prior art.

In this regard, the process of the present invention includes detecting contamination of the transport (conveyor) belt with at least one sensor, generating a state matrix, which includes the location coordinates of the detected contamination, and one of controlling and regulating the cleaning of the transport belt with the at least one cleaning device in accordance with the generated state matrix. Thus, according to the process of the present invention, the control or regulation includes, e.g., activating and deactivating the at least one cleaning device in accordance with the state matrix. Thus, during the cleaning process, the transport belt is cleaned with an intensity that is variable or adapted to the degree of contamination of the respective section of the transport belt in a lateral direction over the width of and/or in the travel direction of the transport belt. Therefore, not all points or regions of the transport belt are acted on with the same cleaning intensity, i.e., the more severely soiled regions of the transport belt are acted on with a higher cleaning intensity than the less severely soiled regions of the transport belt. The imaginary division of the transport belt laterally over the width and/or in the travel direction into parcels or sections and the determination of the respective degree of contamination permits an economical cleaning of the transport belt. Moreover, through selective cleaning intensity, it can be ensured that less severely soiled regions of the transport belt are not strained with an excessively high cleaning intensity. Cleaning the transport belt with different intensity can produce particularly favorable cleaning results so that an interruption of the production process due to an insufficiently thoroughly cleaned transport belt can be practically eliminated. Further, the consumption of cleaning medium can be reduced.

In connection with the instant invention, the term "control" is understood to mean the correction of a particular process without monitoring whether a particular value is maintained, and the term "regulation" is understood to mean the monitoring and correction of a continuously repeating process so that a particular, e.g., constant, value is maintained. The embodiment of the process in which regulation is provided for the cleaning process may be particularly preferable.

In an exemplary embodiment of the process, the transport belt may be cleaned with at least one pressurized gaseous or fluid cleaning medium and the cleaning intensity may be influenced by adjusting the pressure and/or the temperature of the cleaning medium. The greater the pressure and temperature of the cleaning medium, the greater the cleaning action can be, and at a low pressure and/or low temperature of the cleaning medium, the cleaning action may be correspondingly reduced. As a result, transport belt regions that are only slightly soiled can be acted on with a lower pressure cleaning medium and more severely soiled transport belt regions can be acted on with higher pressure cleaning medium. Due to a lower pressure of the cleaning medium, the transport belt can be subjected to a strain that is only relatively slight, which lengthens the service life of transport belts, especially those that are sensitive to such a strain. Alternatively, or in addition to the influence of the cleaning medium pressure, an increase in the cleaning intensity can also be realized by a temperature increase of the cleaning medium.

Another embodiment of the process that may be particularly preferable includes influencing the cleaning intensity via a deliberate predetermination of the duration in which a definite region of the transport belt is cleaned. In another embodiment of the invention, the cleaning intensity may be influenced by adjusting the time interval between two successive cleaning procedures in which one and the same region of the transport belt is cleaned. The cleaning intensity is greater in accordance with a longer duration of cleaning and/or a shorter time interval between two cleaning procedures.

Furthermore, an embodiment of the process that may be preferable includes acting on the cleaning region of the transport belt with a vacuum and adjusting the vacuum as a function of the desired cleaning intensity. With increasing vacuum, even dirt that stubbornly adheres to the transport belt may be reliably dissolved so that desired cleaning results are achieved. With the regulation of suction, it is particularly advantageous that the vacuum requirement and, consequently, the costs for its production can be reduced.

An embodiment of the process that may be preferable includes adjustably applying the quantity of cleaning medium to the transport belt region to be cleaned. The cleaning action can increase with a rising quantity of cleaning medium applied to the transport belt. The quantity of cleaning medium required for a thorough cleaning can be reduced by predetermining the quantity of the at least one fluid or gaseous cleaning medium, which is used for cleaning the transport belt, as a function of, e.g., the degree of contamination of the transport belt region to be cleaned. Water, steam, and air are examples of cleaning mediums.

In accordance with feature of the present invention, the process may be utilized to adjust the moisture profile of the transport belt. By virtue of the fact that the transport belt is cleaned in sections or regions with varying intensity, i.e., viewed laterally to its travel direction and/or in the travel direction, the moisture content in the transport belt can be influenced, and preferably adjusted. As a result, the moisture profile of a material web supported by the transport belt after cleaning can be influenced and preferably adjusted. The adjustment of the moisture profile, i.e., of the water content of the transport belt and of the material web, viewed laterally to its travel direction, can be carried out in accordance with a predetermined, defined profile, in which the intensity of the cleaning of the transport belt is correspondingly adapted.

Further, an apparatus, e.g., a cleaning device, is provided that includes a nozzle device with at least one nozzle which can act on the transport belt with at least one pressurized cleaning medium. The cleaning device may include a nozzle device that is embodied and/or its operating parameters can be varied so that the transport belt can be cleaned with varying intensity laterally over the width and/or in the travel direction as a function of the degree of contamination that is detected with the aid of at least one sensor. As a result, favorable cleaning results can be obtained and at the same time, the consumption of the cleaning medium, which is used for cleaning the transport belt, can be kept relatively low, and preferably minimized. The varying cleaning intensity, which is adapted to the degree of contamination of the individual transport belt sections/zones, furthermore leads to not cleaning less soiled regions of the transport belt with excessive intensity.

In a particularly advantageous exemplary embodiment of the cleaning device, provision can be made that the pressure and/or the temperature of the cleaning medium can be adjustable as a function of the desired cleaning intensity. For example, with a low cleaning intensity, the pressure of the cleaning medium is lower than the pressure or the pressure regions required for intensive cleaning. Thus, straining of the transport belt can at least be reduced in certain areas. Furthermore, it is possible to reduce the operating costs of the cleaning device. Different temperatures of the cleaning medium may influence the cleaning intensity, such that it is preferably true that the higher the temperature of the cleaning medium, the greater the cleaning intensity.

Furthermore, in a particular embodiment of the cleaning device, the nozzle device may be supported so that it can be moved laterally to the travel direction of the transport belt and so that the traversing speed can be adjustable to influence the cleaning intensity. The regions of the transport belt that are intended to be cleaned with a relatively low intensity are, e.g., crossed or passed over more rapidly by the nozzle device than the regions that are subjected to a more intensive cleaning.

Further, in another embodiment of the cleaning device, the pressure of the cleaning medium can be adjusted by a control and/or regulation that controls/regulates the speed of a pump adapted to supply the nozzle device with cleaning medium. The control, e.g., a stored program control (SPC), permits automation of the adjustment of the cleaning intensity of the transport belt or of at least one transport belt region.

Another embodiment of the cleaning device includes a suction chamber which cooperates with the nozzle device and which is flow connected to a suction device via a suction line. The suction capacity of the suction device can be adjusted as a function of the desired cleaning intensity. The term suction capacity is understood here to mean the volume of air aspirated from the cleaning region during a definite time interval. The operating costs of the cleaning device can be reduced by this measure. In an advantageous exemplary embodiment of the apparatus, provision may be made that the suction capacity can be smoothly adjusted via a valve provided in, e.g., the suction line.

The present invention is directed to a process for cleaning a transport belt of a machine for manufacturing and/or processing a material web with at least one cleaning device. The process may include detecting the contamination of the transport belt with at least one sensor, generating a state matrix which contains the location coordinates of the detected contamination, and at least one of controlling and regulating the at least one cleaning device for cleaning over at least a width of the transport belt with a varying desired intensity of cleaning in accordance with the generated state matrix.

According to another feature of the present invention, the process may further include cleaning the transport belt with at least one pressurized cleaning medium, which is one of a gaseous and fluid cleaning medium, and variably adjusting at least one of the pressure and the temperature of the cleaning medium, whereby the cleaning intensity is influenced. A pressure range for applying the cleaning medium may be up to approximately 350 bars, and the process can further include adjustably setting the pressure for applying the cleaning medium within a range between approximately 10 and 275 bars. Further still, the process can include variably setting the temperature of the cleaning medium within a range between approximately 5° C. and 95° C. Still further, the variable adjusting may be performed by at least one one of control and regulation.

According to still another feature of the present invention, the process can further include selecting at least one of the cleaning medium and at least one cleaning additive which is admixed with the cleaning medium in accordance with the desired cleaning intensity.

In accordance with another feature of the present invention, the process may further include establishing a particular time during which a defined region of the transport belt is cleaned. In this manner, the cleaning intensity is influenced.

In a further feature of the present invention, the process may further include adjusting a time interval between successive cleaning procedures in which one and the same region of the transport belt is cleaned. In this manner, the cleaning intensity may be influenced. Further, the process may include reducing the time interval, thereby increasing the cleaning intensity.

According to a still further feature of the present invention, the process may further include acting on a cleaning region of the transport belt with a vacuum, and adjusting a pressure of the vacuum in accordance with the desired cleaning intensity. Further, the adjusting of the pressure of the vacuum can include adjustably setting a pressure within a range up to approximately 0.1 bars.

In another feature of the present invention, an ultrasound cleaning head may be provided for the desired cleaning intensity, and an effective region of the ultrasound cleaning head can extend over one of an entire width and zones arranged over the width of the transport belt.

In accordance with a still further feature of the present invention, the process further can include adjusting the quantity of cleaning medium to be applied to the transport belt region to be cleaned.

According to another feature of the present invention, the process further may include cleaning the edges of the transport belt with a greater intensity than in a transport belt region disposed between the edges.

In a still further feature of the present invention, the process can further include increasing the cleaning intensity as a degree of contamination rises.

According to still another feature of the present invention, the process can further include decreasing the cleaning intensity as a degree of contamination falls.

In accordance with yet another feature of the present invention, the process may further include adjusting a moisture profile of the transport belt with the cleaning device.

In accordance with still another feature of the present invention, the material web may include at least one of a paper and a cardboard web.

According to a further feature of the present invention, the one of controlling and regulating the intensity of cleaning in accordance with the degree of contamination may be determined from the equation:

$$p(\Delta)=A\cdot arc\tan\Delta+B,$$

where p represents pressure, Δ represents the degree of contamination, A+B represents a maximum pressure, and B represents a minimum pressure that is greater than or equal to 0.

According to still another feature of the present invention, the process can further include dividing the transport belt into a plurality of zones, monitoring the degree of contamination within each of the plurality of zones, and one of controlling and regulating the intensity of cleaning in each of the plurality of zones.

In yet another feature of the present invention, the process may further include actuating a valve to regulate a flow of cleaning fluid to the cleaning device.

In accordance with a still further feature of the present invention, the process may also include adjustably setting a traversing speed for the cleaning device to traverse the width of the transport belt within a range between approximately 0.01 m/min and 1.0 m/min, and preferably can include adjustably setting the traversing speed within a range between approximately 0.1 m/min and 0.6 m/min.

The present invention also relates to an apparatus for cleaning a transport belt of a machine for manufacturing and/or processing a material web. The apparatus includes a nozzle device including at least one nozzle. The nozzle device is adapted to adjustably apply at least one pressurized cleaning medium onto the transport belt, so as to adjust a cleaning intensity. The apparatus also includes at least one sensor positioned to detect a degree of contamination of the transport belt. The nozzle device is adapted to clean the transport belt with a varying intensity of cleaning at least one of laterally over the width and in the travel direction in accordance with a degree of contamination detected.

According to another feature of the present invention, at least one of the pressure and the temperature of the cleaning medium may be adjustable in accordance with the desired cleaning intensity.

In a still further feature of the present invention, at least one control and regulation device can be adapted to adjust a pressure of the cleaning medium, and a pump can be associated with the at least one control and regulation device to supply the cleaning medium to the nozzle device. A speed of the pump may be influenced by the pressure of the cleaning medium.

According to still another feature of the present invention, a support device may be provided and the nozzle device can be coupled to the support device for movement laterally over the width of the transport belt. A traversing speed of the nozzle device can be adjustable to influence the cleaning intensity.

In yet another feature of the present invention, a suction device may be provided, a suction chamber may be coupled to the suction device through a suction line, and the suction chamber may be adapted to cooperate with the nozzle device. A suction capacity of the suction device can be adjustable in accordance with the desired cleaning intensity. Further, a valve can be provided in the suction line to smoothly adjust the suction capacity.

In accordance with another feature of the present invention, the at least one nozzle of the nozzle device may include at least two nozzles that are independently activatable and deactivatable from each other. The independent activation can influence the cleaning intensity.

According to a further feature of the present invention, the at least one sensor may be adapted to measure one of at least one of water and air permeability and water storing behavior of the transport belt. Further, the at least one sensor can be operable during the operation of the machine.

In accordance with a still further feature of the present invention, at least one ultrasound cleaning head may be provided.

In still another feature of the present invention, the material web can include at least one of a paper web and a cardboard web.

According to still another feature of the present invention, a valve and pumping station may be coupled to the nozzle device, and may be adapted to regulate a flow of cleaning fluid to the nozzle device.

According to another feature of the present invention, a measurement station can be coupled to the at least one sensor to receive signals from the at least one sensor. Further, the measurement station can measure at least one of humidity, water permeability, and dry content.

In accordance with a further feature of the present invention, a pump may be provided for supplying a cleaning fluid to the nozzle device, a control and regulation unit can be provided to control the pump, and a computer can be provided to determine the degree of contamination of the transport belt and to forward the monitored degree of contamination to the control and regulation unit.

According to yet another feature of the present invention, a computer may be provided to logically divide the transport belt into a plurality of sections. The degree of contamination for each of the plurality of sections can be detected.

The present invention also relates to a process for cleaning a transport belt of a machine to manufacture a material web. The process includes cleaning the transport belt across a total width of the transport belt with a cleaning device, and varying intensity of the cleaning over the total width of the transport belt with a control and regulation unit.

In a still further feature of the present invention, the process may further include detecting contamination of the transport belt with at least one sensor, generating a state matrix which contains the location coordinates of the detected contamination, and at least one of controlling and regulating the cleaning device for cleaning over at least a width of the transport belt with a varying desired intensity of cleaning in accordance with the generated state matrix.

The invention relates to an apparatus for cleaning a transport belt of a machine for manufacturing and/or processing a material web. The apparatus includes a nozzle device including at least one nozzle, and a control and regulation unit adapted to adjustably vary a cleaning intensity of the nozzle device laterally over a width of the transport belt.

In accordance with yet another feature of the present invention, at least one sensor may be positioned to monitor a degree of contamination on the transport belt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
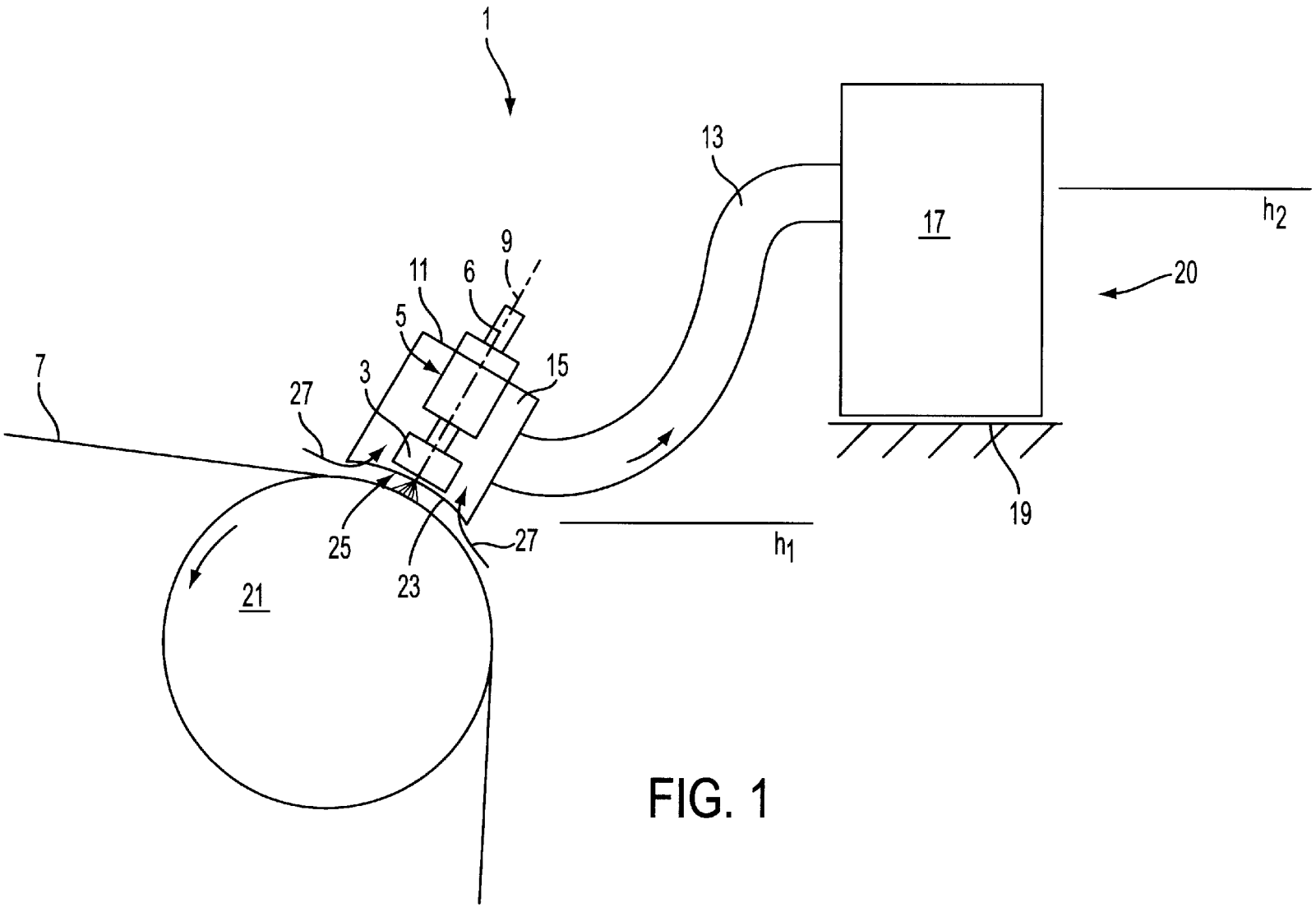
FIG. 1 illustrates a side view of an exemplary embodiment of the cleaning device according to the present invention.

The device 1 depicted in FIG. 1 is utilized to clean a transport (conveyor) belt of a machine (not shown in detail) for the manufacturing and/or processing a material web, e.g., a paper, cardboard, textile, or plastic web, and the like. The device will be referred herein as cleaning device 1.

Cleaning device 1 can be utilized for any transport (transport) belts of a machine for manufacturing and/or processing a material web, e.g., wire belts (or sieves) or felts of a wire section, press section, or dryer section of paper and/or cardboard making machine or of a transport belt for a material web coating machine (coater). The term "transport belts" also includes the wires (sieves) or felts utilized within a former positioned to precede the press section and the dryer section. The transport belts can be formed as porous or impermeable to media. Purely by way of example, it can be assumed that these are transport belts of a paper making machine, however, this example is merely for the purposes of explanation, and should not be construed as limiting.

Cleaning device 1 includes a nozzle device 5 having a nozzle head 3. Nozzle head 3 can include at least one nozzle (not shown in detail) which acts on a porous transport belt 7 with a fluid cleaning medium, e.g., a water or a gaseous cleaning medium, such as steam. By way of example, it can be assumed that the cleaning medium is a fluid at a pressure from between approximately 100 bar and 1000 bar. Further, a connection 6, which is partially depicted in FIG. 1, can be provided, which can be attached to a pressure hose connected to a pump. In this way, nozzle 5 can be supplied with cleaning medium.

In an alternative embodiment, nozzle head 3 can be rotatable around its longitudinal axis 9 and can include a nozzle device having one or more driving jets from which the cleaning medium emerges or is sprayed tangentially to the transport belt surface. In this manner, rotational movement of nozzle head 3 can produce a rotational movement. Moreover, one or more cleaning nozzles can be directed to apply or spray cleaning medium onto transport belt 7. The rotation of the nozzle head can alternatively be produced in a different manner than the above example of driving jets.

Nozzle device 5 is completely encompassed by a sleeve-shaped suction bell 11. The interior of suction bell 11 is connected to a suction line 13 to form a suction chamber 15 associated with nozzle device 5. Suction line 13 can be attached to a traversing carriage 17 and can be flow connected to a vacuum source (not shown). Traversing carriage 17 can be moved along a traverse 19 (depicted very schematically) that extends laterally to the travel direction of transport belt 7. Traversing carriage 17 and traverse 19 form a traversing unit 20.

As shown in FIG. 1, cleaning device 1 can be associated with a deflection roll 21, which is positioned so that transport belt 7 will be guided therearound. Suction bell 11 extends over a partial region of the circumference face of deflection roll 21 and is located in spaced relation from deflection roll 21. An end region 23 of suction bell 11 is oriented toward transport belt 7 and is structured and arranged to the circular, cylindrical circumference form or face of deflection roll 21. Thus, a gap between suction bell 11 and transport belt 7 is essentially constant. The distance between suction bell 11 and transport belt 7 can be adjustable, which is not addressed in more detail. In another embodiment, cleaning device 1 may be disposed in the vicinity of a free draw of transport belt 7, which is composed of a wire, a felt, or the like. In this regard, the term "free draw" is understood to mean a travel path of the transport belt in which the transport belt is not supported by a guide device, e.g., a roll or the like.

The operation of cleaning device 1 is explained in more detail below. Transport belt 7, which is guided over deflection roll 21, can be acted on by nozzle device 5 with pressurized cleaning fluid (nozzle stream 25). The cleaning fluid may be applied within a pressure of, e.g., up to approximately 350 bars, and preferably between approximately 10 and 275 bars. In so doing, coarse particles and dirt are removed from transport belt 7 and at least partially, and preferably completely, removed from the surface of transport belt 7 by via suction bell 11. In a definite manner, so-called secondary air can be aspirated from the surroundings into suction chamber 15 through the definite gap distance between suction bell 11 and transport belt 7. The dirt and cleaning fluid travel with the suctioned air. These elements are removed from suction chamber 15 via suction line 13. The flow that is formed by the aspiration of secondary air is indicated with arrows 27. The flow can be deliberately changed by adjusting the distance between suction bell 11 and transport belt 7. Since a definite air flow is admitted from the environment into suction chamber 15, an outlet (drainage) line (not shown), which can be attached to traversing carriage 17 and fed by suction line 13, can be disposed at a higher level $h_2$ than nozzle device 5, which is disposed at a level identified as $h_1$. As a result, universal installation positions of traversing unit 20 formed by traversing carriage 17 and traverse 19 may be advantageously possible so that a compact construction of the machine can be realized.

With cleaning device 1, as explained in conjunction with FIG. 1, or with movable nozzle device 5, transport belt 7 can be cleaned with varying intensity in a lateral direction over its width. For this purpose, the pressure of the cleaning medium, i.e., the cleaning fluid in this instance, and/or the temperature of the cleaning medium, can be adjusted as a function of the desired cleaning intensity. For example, a temperature range for the cleaning fluid may be, e.g., between approximately 5° C. and 95° C. As a further example, to intensify a cleaning process, the pressure can be increased, e.g., from 200 bars to 250 bars, the temperature can be increased, e.g., in 5 Kelvin increments, or some combination thereof. Adjustment of the pressure of the cleaning fluid can occur, e.g., via a control/regulation unit (not shown in FIG. 1), which controls the delivery capacity of a pump utilized to supply nozzle device 5 with cleaning fluid. The action of nozzle stream 25 and consequently the cleaning intensity may be reduced as a result of a low pressure. Correspondingly, cleaning intensity is increased with rising pressure.

The intensity of cleaning of transport belt 7 can also be influenced, and preferably adjusted, by varying the traversing speed of nozzle device 5. With a high traversing speed, a dwell time of nozzle stream 25 on one and the same location of transport belt 7 is shortened in relation to a lower traversing speed. For example, the traversing speed may be within a range of, e.g., between approximately 0.01 m/min and 1.0 m/min, and preferably between approximately 0.1 m/min and 0.6 m/min. In other words, with a high speed, there is less of a cleaning action than with a lower speed. In another exemplary embodiment, both the pressure of the cleaning fluid and the traversing speed can be variable in order to influence the cleaning intensity.

In another possibility for adjusting the cleaning action of cleaning device 1, the suction capacity of the suction device, e.g., up to approximately 0.1 bars, can be variable, for example, by inserting a valve into suction line 13. In this way, the volume to be aspirated from suction chamber 15 can be adjustable. The valve can be formed, e.g., as a proportional valve that can be smoothly adjusted, which is known in the art. In order to increase the cleaning action, additional cleaning nozzles can also be provided, which can be separately or independently activated and deactivated from each other. In this way, one or more of the additional nozzles can be switched on or switched off before or during a cleaning process.

It should be apparent that any one of the above described possibilities for influencing the cleaning intensity of cleaning device 1 can be utilized individually, and can also be utilized in simultaneously and/or in combination with one or more of the above-described influencing possibilities to produce desired cleaning results. As a result, the action of cleaning device 1, i.e., the intensity with which transport belt 7 is to be cleaned, can be adjusted as a function of how severely transport belt 7, when viewed transversely to the belt travel direction, is soiled. As a result, it may be possible to reduce the demand for cleaning medium and/or vacuum in comparison to those known cleaning devices. Moreover, an ultrasound cleaning head, whose cleaning intensity can preferably be adjusted, and in particular regulated, can also be used to clean transport belt 7. The design and function of an ultrasound cleaning head mentioned here are known in principle so that a more detailed description is not necessary.

Figure 2:
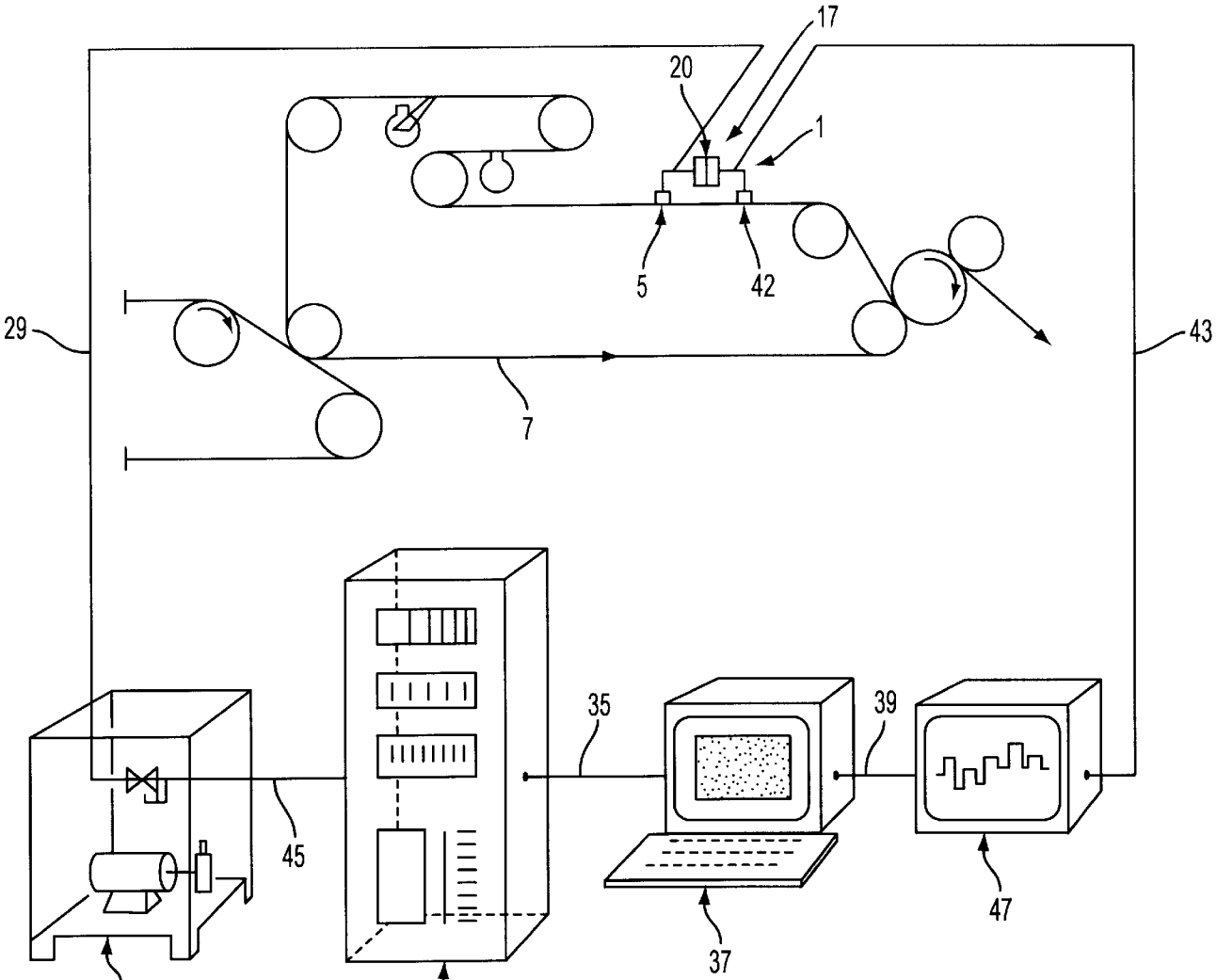
FIG. 2 schematically illustrates a second exemplary embodiment of the cleaning device of the present invention.

FIG. 2 schematically illustrates a detail of a paper making machine utilizing cleaning device 1. The same parts are provided with the same reference numerals so that reference can be made in this regard to the description of FIG. 1. Purely by way of example, cleaning device 1 may be utilized inside a press section of the paper making machine and can be arranged within a region between two deflection rolls arranged to guide transport belt 7. Nozzle device 5, which can be moved laterally over the width of transport belt 7 with the aid of traversing carriage 17, can communicate via a supply line 29 with a valve and pumping station 31 for the cleaning medium. Cleaning device 1 can further include a switching cabinet 33 provided for housing a control and regulation unit for cleaning device 1. Switching cabinet 33 may communicate via first signal lines 35 with a computer 37, which in turn may be connected to a measurement station 41 via second signal lines 39. Further, a sensor 42 can be connected to traversing carriage 17 and can communicate with measurement station 41 through a third signal line 43. Sensor 42 can be positioned directly before nozzle device 5, i.e., relative to the belt travel direction. In another embodiment, the installation location of sensor 42 can deviate greatly from that of cleaning device 1, i.e., the sensor can also be positioned at a large distance from cleaning device 1. The quantity and preferably also the desired temperature of the cleaning medium, which can be supplied through the valve and pumping state 31 to nozzle device 5, can be transmitted through a fourth signal line 45 from the control and regulation unit accommodated in the switching cabinet 33 to pumping station 31.

Figure 3:
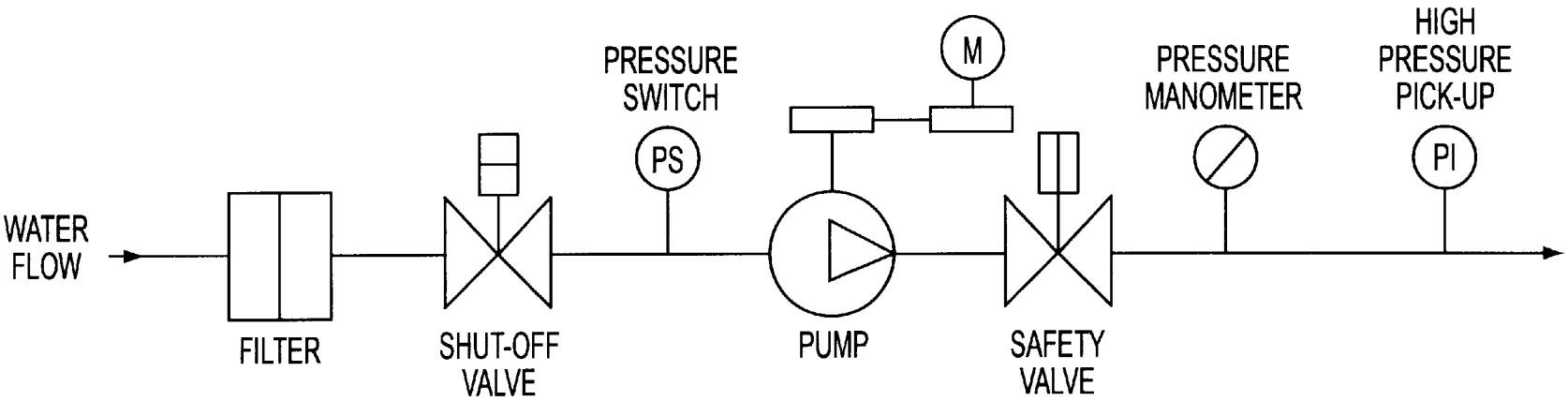
FIG. 3 illustrates a detailed view of the valve and pumping station depicted in FIG. 2.

A more detailed illustration of pumping station 31 is illustrated in FIG. 3. As shown in FIG. 3, an incoming water flow can be filtered prior to passing through a shut-off valve. A pressure switch is positioned before a pump, which may be motorized. A safety valve is located downstream of the pump, regulates flow to a pressure monometer and a high pressure pick-up.

Figure 4:
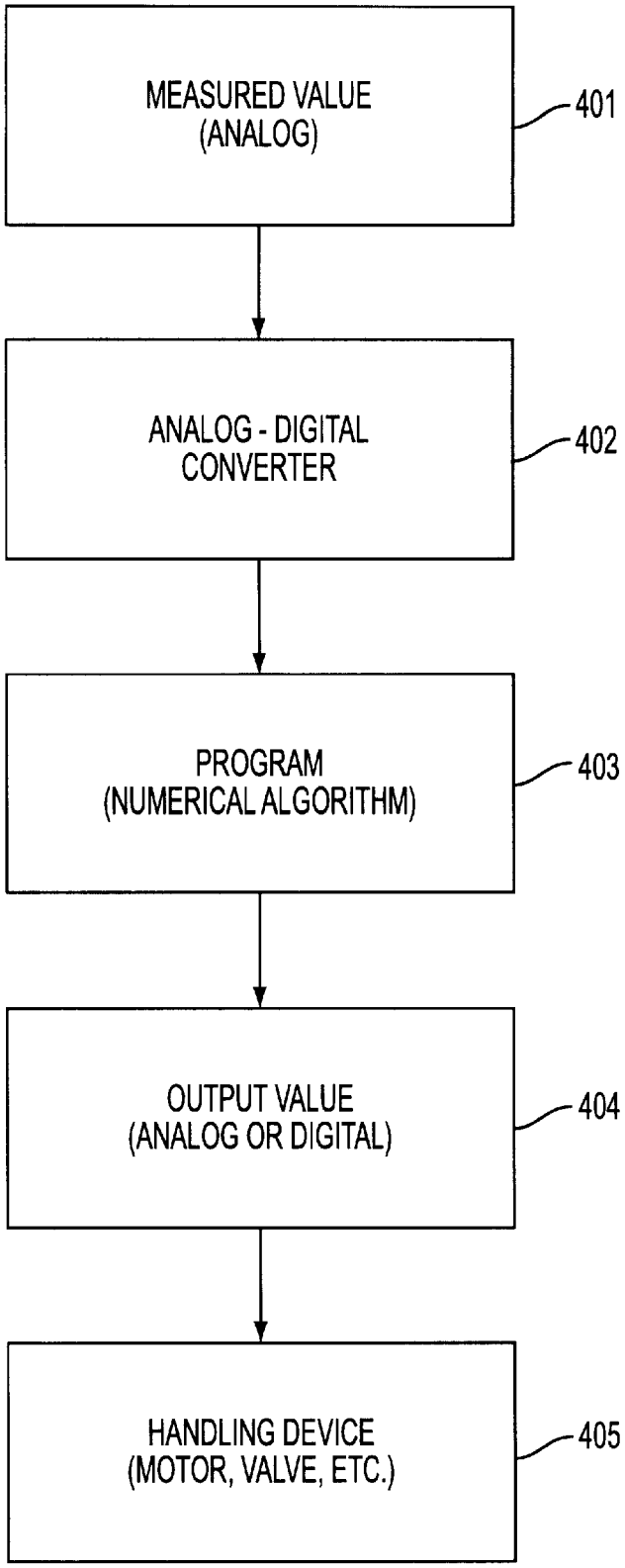
FIG. 4 illustrates an exemplary flow diagram for the operation of the control and regulation unit.
Figure 5:
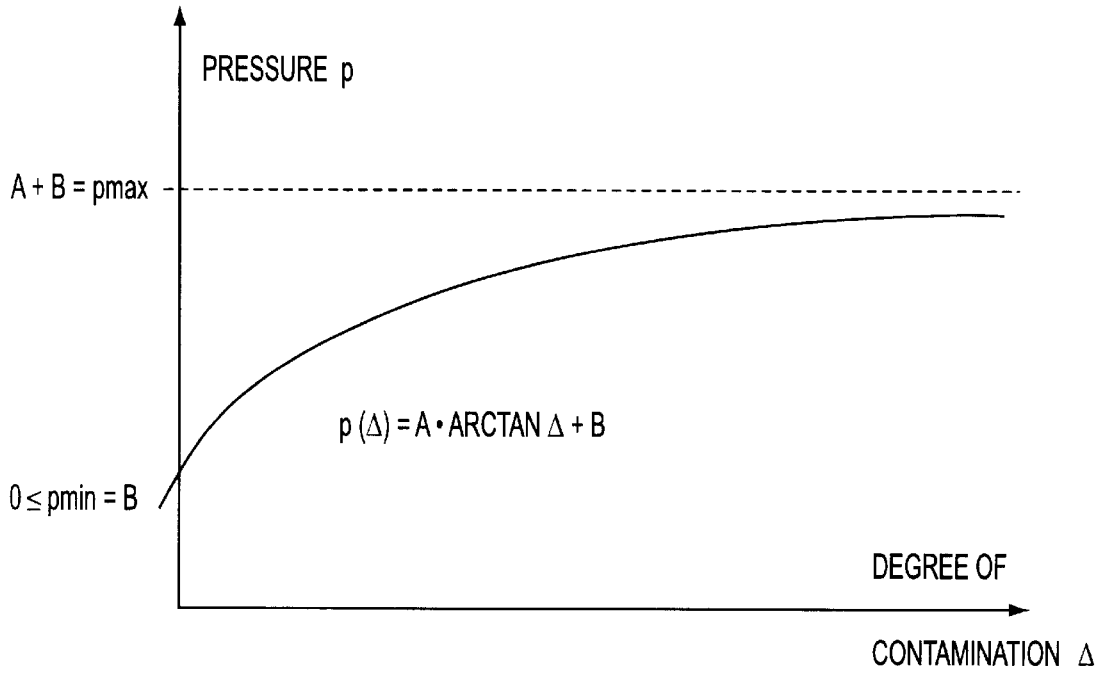
FIG. 5 illustrates graphical plot of an equation for the control and regulation of the cleaning intensity.

The control and regulation unit within housing 33 can operate, e.g., in accordance with the flow diagram shown in FIG. 4. The process within the control and regulation unit may include receiving, at step 401, a measured value, e.g., an analog value from the measurement station 41, which will be converted into a digital value at step 402. The digital value is then input into a program or numerical algorithm at step 403 to provide an output value at step 404, which may be, e.g., in analog or digital form. At step 405, a handling device, e.g., a motor, valve, etc., is activated/deactivated, if necessary, to regulate the cleaning intensity of cleaning device 1. The program or numerical algorithm in step 403 may be, e.g., in accordance with the equation:

$$p(\Delta)=A\cdot arc\tan\Delta+B,$$

where p represents pressure, Δ represents the degree of contamination, A+B represents a maximum pressure, and B represents a minimum pressure that is greater than or equal to 0. An exemplary plot of the above-noted equation is illustrated in FIG. 5.

The determination of the degree contamination Δ may correspond to a difference between parameters, e.g., humidity, permeability, dry content, before and after the cleaning process. Humidity can be measured, e.g., with an "L & W Scanpro PressTuner," the water permeability can be measured, e.g., with an "L & W Scanpro FeltPerm," and the dry content can be measured, e.g., with an "L & W Scanpro MSC-120." These measuring devices can be associated with measurement station 41.

With regard to cleaning device 1, during movement of traversing carriage 17 laterally across the width of transport belt 7, the degree of contamination of entire transport belt 7, which can be divided into imaginary zones or parcels, may be detected with sensor 42. From the obtained values of the degree of contamination of the individual zones, a state matrix (also called a state card) can be generated via computer 37. This matrix may contain the location coordinates of the detected contaminations, i.e., their exact position on transport belt 7. Depending on the information coming from the state matrix, a "cleaning matrix" can be generated, which gives the cleaning intensity for each transport belt zone that has been suggested by computer 37. Based on the cleaning matrix, at least one cleaning device can be controlled, e.g., activated or deactivated, by a computer program. The term "cleaning device" is understood to mean, e.g., a cleaning device 1 described in conjunction with FIG. 1, a doctor, a blower, and/or suction device, and the like. The choice of the cleaning device is preferably made as a function of the type of contamination and/or the degree of contamination, i.e., whether the transport belt is severely or less severely soiled. According to a particular embodiment, the state matrix can be correspondingly corrected continuously during the selective cleaning, i.e., with a cleaning intensity that is adapted to the degree of contamination of the individual transport belt parcels. Through the cleaning of imaginary transport belt zones, which extend in the travel direction and laterally across the width of transport belt 7, with a cleaning intensity adapted to the degree of contamination, an economical cleaning is possible. In this way, an excessive straining of the individual transport belt regions due to an excessive cleaning intensity, which would not be necessary for a sufficient cleaning of these regions, is prevented.

The cleaning intensity can be changed by varying the effective duration of the cleaning medium or the cleaning device, the working pressure and/or the temperature of the cleaning medium. Moreover, cleaning intensity can be changed by the choice of the cleaning medium or the cleaning additive(s) that are admixed with the respective cleaning medium. Cleaning additives can be, e.g., sodium hydroxide etching solution, diluted acids, or paraffins.

In a particular embodiment, as the degree of contamination increases, the cleaning intensity rises and as the degree of contamination decreases, the cleaning intensity falls. As a result, a rapid equalization of the degree of contaminations of the individual imaginary transport belt parcels/zones/sections is possible, with a simultaneous, general reduction of the degree of contamination. Since the cleaning intensity depends on the degree of contamination of the respective transport belt region, the following relationship preferably exists between two parcels/sectors of the transport belt:

$$\Delta\text{ cleaning intensity }(\%)>\Delta\text{ degree of contamination }(\%).$$

The above-mentioned process readily follows from the description of FIGS. 1 and 2. In particular, the process includes detecting contamination of the transport belt with the aid of at least one sensor, generating a state matrix that contains the location coordinates of the contamination(s), and controlling or regulating the at least one cleaning device for cleaning the transport belt in accordance with the state matrix. Moreover, the process according to the present invention can utilized to adjust the moisture profile of transport belt 7. By a mutual coordination of the traversing speed, the pressure and/or the temperature of the cleaning medium, the duration of the cleaning, the duration of the time interval between two successive cleaning procedures, the activation of additional cleaning nozzles and/or the control/regulation of the suction capacity of the suction device, it is possible to set a precise water content in transport belt 7 laterally over the width. As a result, a direct influence can be exerted on the moisture profile of a material web that is supported by transport belt 7 after it is cleaned. However, it is also possible to influence the moisture profile of the material web, the profile of which is adjustable with the aid of suitable devices and monitored by cross-wise profile measurement devices. The adjustment of the moisture profile of a transport belt, e.g., a press felt of a press section, can take place manually or automatically, preferably following a preset profile, via controlling, preferably by regulating, the cleaning intensity.

The intensity with which transport belt 7 is cleaned in certain areas depends on the degree of contamination. It has turned out that frequently, the edges of transport belt 7 become more severely soiled than the transport belt section disposed between them. Thus, these edges must be cleaned with a greater intensity. This can be realized with one of the above-described measures.

In order to determine the degree of contamination of the transport belt, an individual sensor can be used, which can be laterally moved over or across the width of the transport belt. Alternatively, a number of sensors can be used, which are disposed in a stationary manner and are distributed laterally over the width of the transport belt. The degree of contamination of the transport belt can preferably be measured with the aid of the at least one sensor. In one embodiment, the water and/or air penetrability, i.e. the permeability, or the water storing behavior of the transport belt is measured by the at least one sensor.

In view of the foregoing, it is apparent that by cleaning transport belt 7 with varying intensities over its width, the operating costs of cleaning device 1 and, thus, of the machine for manufacturing a material web, can be reduced with uniformly favorable cleaning results.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for cleaning a transport belt of a machine for at least one of manufacturing and processing a material web with at least one cleaning device, the process comprising:

detecting contamination of the transport belt with at least one sensor;

generating a state matrix which contains location coordinates of the detected contamination; and at least one of controlling and regulating the at least one cleaning device for cleaning over at least a width of the transport belt with a varying desired intensity of cleaning in accordance with the generated state matrix, wherein the cleaning intensity increases as a degree of contamination rises, and the cleaning intensity decreases as a degree of contamination falls.

2. The process according to claim 1, further comprising:

cleaning the transport belt with at least one pressurized cleaning medium, which is one of a gaseous and fluid cleaning medium; and adjusting at least one of a pressure and a temperature of the cleaning medium, whereby the cleaning intensity is influenced.

3. The process according to claim 2, wherein a pressure range for applying the cleaning medium is up to approximately 350 bars.

4. The process according to claim 3, wherein the process further comprising adjustably setting the pressure for applying the cleaning medium within a range between approximately 10 and 275 bars.

5. The process according to claim 2, further comprising setting the temperature of the cleaning medium within a range between approximately 5° C. and 95° C.

6. The process according to claim 2, wherein the adjusting is performed by at least one of control adjustment and regulate adjustment.

7. The process according to claim 1, further comprising selecting at least one of cleaning medium and at least one cleaning additive which is admixed with the cleaning medium in accordance with the desired cleaning intensity.

8. The process according to claim 1, further comprising establishing a particular time during which a defined region of the transport belt is cleaned, whereby the cleaning intensity is influenced.

9. The process according to claim 1, further comprising adjusting a time interval between successive cleaning procedures in which one region of the transport belt is cleaned, whereby the cleaning intensity is influenced.

10. The process according to claim 9, further comprising reducing the time interval, thereby increasing the cleaning intensity.

11. The process according to claim 1, further comprising:

acting on a cleaning region of the transport belt with a vacuum; and adjusting a pressure of the vacuum in accordance with the desired cleaning intensity.

12. The process according to claim 11, wherein the adjusting of the pressure of the vacuum comprising adjustably setting a pressure within a range up to approximately 0.1 bars.

13. The process according to claim 1, wherein an ultrasound cleaning head is provided for the desired cleaning intensity, and an effective region of the ultrasound cleaning head extends over one of an entire width and zones arranged over the width of the transport belt.

14. The process according to claim 1, further comprising adjusting a quantity of cleaning medium to be applied to a transport belt region to be cleaned.

15. The process according to claim 1, further comprising cleaning edges of the transport belt with a greater intensity than in a transport belt region disposed between the edges.

16. The process according to claim 1, further comprising adjusting a moisture profile of the transport belt with the cleaning device.

17. The process according to claim 1, wherein the material web comprises at least one of a paper and a cardboard web.

18. The process according to claim 1, further comprising:

dividing the transport belt into a plurality of zones;

monitoring a degree of contamination within each of the plurality of zones; and one of controlling and regulating the intensity of cleaning in each of the plurality of zones.

19. The process according to claim 1, further comprising:

actuating a valve to regulate a flow of cleaning fluid to the cleaning device.

20. The process according to claim 1, further comprising setting a traversing speed for the cleaning device to traverse the width of the transport belt within a range between approximately 0.01 m/min and 1.0 m/min.

21. The process according to claim 20, further comprising setting the traversing speed within a range between approximately 0.1 m/min and 0.6 m/min.

22. A process for cleaning a transport belt of a machine for at least one of manufacturing and processing a material web with at least one cleaning device, the process comprising:

detecting contamination of the transport belt with at least one sensor;

generating a state matrix which contains location coordinates of the detected contamination; and at least one of controlling and regulating the at least one cleaning device for cleaning over at least a width of the transport belt with a varying desired intensity of cleaning in accordance with the generated state matrix, and one of controlling and regulating the intensity of cleaning in accordance with a degree of contamination being determined from an equation:

$$p(\Delta)=A\cdot arctan\Delta+B,$$

where p represents pressure, Δ represents the degree of contamination, A+B represents a maximum pressure, and B represents a minimum pressure that is greater than or equal to 0.

23. A process for cleaning a transport belt of a machine to manufacture a material web, comprising:

detecting contamination of the transport belt with at least one sensor;

generating a state matrix which contains the location coordinates of the detected contamination;

cleaning the transport belt across a total width of the transport belt with a cleaning device in accordance with the generated state matrix; and varying intensity of the cleaning over the total width of the transport belt, based upon the generated state matrix.

24. The process according to claim 23, further comprising:

at least one of controlling and regulating the cleaning device for cleaning over at least a width of the transport belt with a varying desired intensity of cleaning in accordance with the generated state matrix with a control and regulation unit.

25. The process according to claim 23, wherein a control and regulation unit controls at least one of a pressure of a cleaning fluid supplied to the cleaning device, a temperature of a cleaning fluid supplied to the cleaning device, and a traversing speed of the cleaning device across the transport belt.

* * * * *